US005184901A

United States Patent [19]

Tanaka et al.

[11] Patent Number: 5,184,901

[45] Date of Patent: Feb. 9, 1993

[54] DISPLACEMENT MAGNIFYING MECHANISM FOR A PRINT ELEMENT

[75] Inventors: Shinzo Tanaka; Syuichi Yamaki, both of Kawasaki, Japan

[73] Assignee: Fujitsu Ltd., Kawasaki, Japan

[21] Appl. No.: 550,545

[22] Filed: Jul. 10, 1990

[30] Foreign Application Priority Data

Jul. 20, 1989 [JP] Japan ..... 1-186074
Aug. 15, 1989 [JP] Japan ..... 1-209693
Aug. 15, 1989 [JP] Japan ..... 1-209694

[51] Int. Cl.[5] ..... B41J 2/26

[52] U.S. Cl. ..... 400/124; 400/157.1; 101/93.05

[58] Field of Search ..... 400/124, 157.1; 101/93.05

[56] References Cited

U.S. PATENT DOCUMENTS 4,886,382 12/1989 Oota et al. ..... 400/124
5,005,994 4/1991 Yano ..... 400/124

FOREIGN PATENT DOCUMENTS 285766 10/1988 European Pat. Off. ..... 400/157.1
0295102 12/1988 European Pat. Off. .
0333595 9/1989 European Pat. Off. .
256662 11/1987 Japan ..... 400/124
17060 1/1988 Japan ..... 400/124

*Primary Examiner*—Clifford D. Crowder
*Assistant Examiner*—J. R. Keating
*Attorney, Agent, or Firm*—Staas & Halsey

[57] ABSTRACT

A displacement magnifying mechanism includes a base member and an electro actuator having a free ene and a base end connected to the base member, and having an actuator axis defined as passing through the free end and the base ene. The electro actuator has a rest state and an actuated state of extending and contracting along the actuator axis. The mechanism further includes an arm having first and second ends. A first resilient member has a first end connected to the free end of the electro actuator, and a second end connected to the second end of the arm. A second resilient member has a first end connected to the base member, and has a second end connected to the second end of the arm. The second resilient member is substantially parallel and substantially overlaps the first resilient member, and a distance between the first resilient member and second resilient member is less than a width of the electro actuator at a direction perpendicular to the actuator axis. The above mechanism allows the interval between the first and second resilient members to be narrowed without increasing the width, thus also improving the mounting efficiency and displacement magnifying efficiency.

34 Claims, 8 Drawing Sheets

DISPLACEMENT MAGNIFYING MECHANISM FOR A PRINT ELEMENT

BACKGROUND OF THE INVENTION

This invention relates to a displacement magnifying mechanism for a print element. More particularly, this invention relates to a displacement magnifying mechanism having a piezo-electric element for driving a print element.

In recent years, a printer is required to realize a high speed printing operation. In order to attain such an objective, a piezo-electric element is used for the driving source of the print element. In addition, a highly efficient displacement magnifying mechanism is necessary to realize yet a higher speed printing operation.

FIG. 1 is a perspective view of a conventional print element having a displacement magnifying mechanism. FIG. 2 is a perspective view of a conventional connection part for the print element of FIG. 1. FIG. 3 is a further perspective view of a conventional connection part for the print element of FIG. 1.

The conventional print element comprises a fixing member 6 and a piezo-electric element 5 operable in a longitudinal mode. The fixing member 6 has opposite side portions 6*a*, 6*b* and a bottom portion 6*c* so that member 6 has a U-shaped configuration. The piezo-electric element 5 is disposed between the opposite portions 6*a*, 6*b*. The piezo-electric element 5 has a base end 5*a* and a free end 5*b*. The base end 5*a* is fixed to the bottom portion 6*c* of the fixing member 6. The element axis passes through the base end and the free end.

It should be understood that the piezo-electric element 5 is depicted in FIG. 1 in a rest state, wherein no voltage is supplied across the piezo-electric element 5. When a voltage is supplied across the piezo-electric element 5, the piezo-electric element 5 is put in an actuated state to extend so that the free end 5*b* moves away from the base end 5*a* along the element axis. When the voltage is removed, the piezo-electric element 5 contracts along the element axis to return to the rest state. In summary, the piezo-electric element 5 has rest and actuates states, in which the piezo-electric element 5 extends and contracts along the element axis to give a displacement to the free end relative to the base end.

The print element also includes an arm 1 with a first end and a second end, the first end of the arm 1 having an arm base 1*a* and the second end of arm 1 having a print wire 8. A first resilient hinge 2 has first and second ends. The first end of the first resilient hinge 2 is connected to the free end 5*b* of the piezo-electric element 5 through a junction member 7. The second end of the resilient hinge 2 is connected to the arm base 1*a*. A second resilient hinge 3 has first and second ends. The first end of the second resilient hinge 3 is connected to the side portion 6*a* of the fixing member 6. The second end of the second resilient hinge 3 is connected to the arm base 1*a*. A third resilient hinge 4 has first and second ends. The first end of the third first resilient hinge 4 is connected to the side portion 6*b* of the fixing member 6. The second end of third resilient hinge 3 is connected to the arm base 1*a*.

When a voltage is supplied across the piezo-electric element 5 (actuate state), the piezo-electric element 5 moves the junction member 7 a predetermined amount in the direction of the arrow "A" shown in FIG. 1, thereby applying a compression force on the first resilient hinge 2. As a result, the end of the arm 1 moves in the direction of the arrow mark "B" shown in FIG. 1 due to the elastic effect of the hinges 2, 3 and 4. In this case, a sufficient magnifying displacement mechanism is applied to the print head, the print wire 8 being activated when the arm 1 moves. When the voltage is removed at a predetermined period, the piezo-electric element 5 contracts along the element axis to return to the rest state, that is, its initial position. Similarly, the hinges 2, 3 and 4 return to their initial positions. In this case, since extension and contraction of piezo-electric element 5 are carried out quickly, high speed printing can be realized by applying this displacement magnifying mechanism to the print head.

This type of printer arrangement is further disclosed in European Patent Publication (A1) No. 0 285 766, published on Dec. 10, 1988.

Improvement in displacement magnifying efficiency of this print head would require a smaller interval between the parallel first resilient hinge 2 and second and third resilient hinges 3, 4. However, if this was attempted, the second and third resilient hinges 3, 4 connected to side portions 6*a*, 6*b* of the fixing member and junction member 7 would collide with each other. Therefore, the conventional print head has resulted in a bad mounting efficiency because the second and third hinges 3, 4 are provided on both sides of the first hinge such as to avoid the first hinge 2 and piezo-electric element 5, thereby requiring a larger width for the mechanism.

SUMMARY OF THE INVENTION

Accordingly, it is a primary object of the present invention to provide an improved displacement magnifying efficiency of a displacement magnifying mechanism.

Another object of the present invention is to provide an improved mounting efficiency of the print element.

A further object of the present invention is to provide a displacement magnifying mechanism for high speed operation of the print element.

Another object of the present invention is to provide a displacement magnifying mechanism for reducing manufacturing costs and assembling time.

Yet another object of the present invention is to provide a displacement magnifying mechanism for reducing assembling parts.

To achieve the foregoing objects and in accordance with the purposed of the invention, as embodied and broadly described herein, there is provided a displacement magnifying mechanism comprising: (a) a base member; (b) an electro actuator having a free end, a base end connected to the base member, and an actuator axis defined as passing through the free end and the base end, the electro actuator having a rest state and an actuated state of extending and contracting along the actuator axis; (c) an arm having a first end and a second end; (d) a first resilient member having a first end connected to the free end of the electro actuator, and having a second end connected to the second end of the arm; and (e) a second resilient member having a first end connected to the base member and a second end connected to the second end of the arm, the second resilient member being substantially parallel with the first resilient member, and a distance between the first resilient member and second resilient member being less than a width of the electro actuator at a direction perpendicular to the actuator axis.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
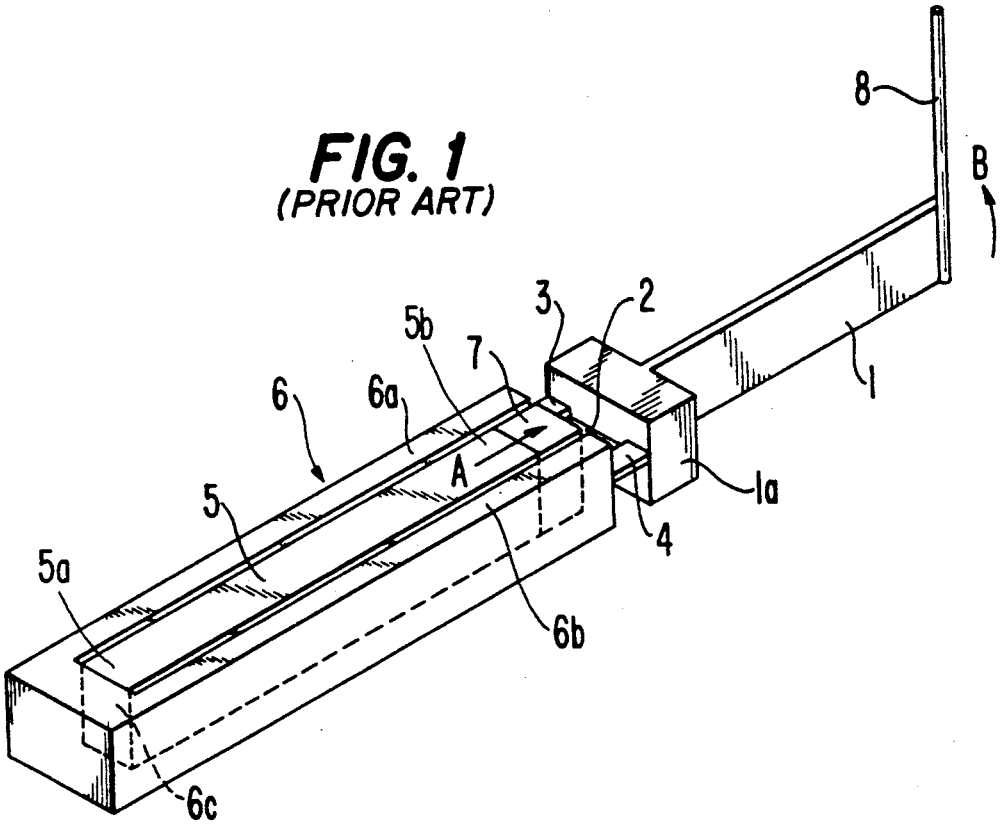
FIG. 1 (PRIOR ART)
FIG. 1 is a perspective view of a conventional print element.
Figure 2:
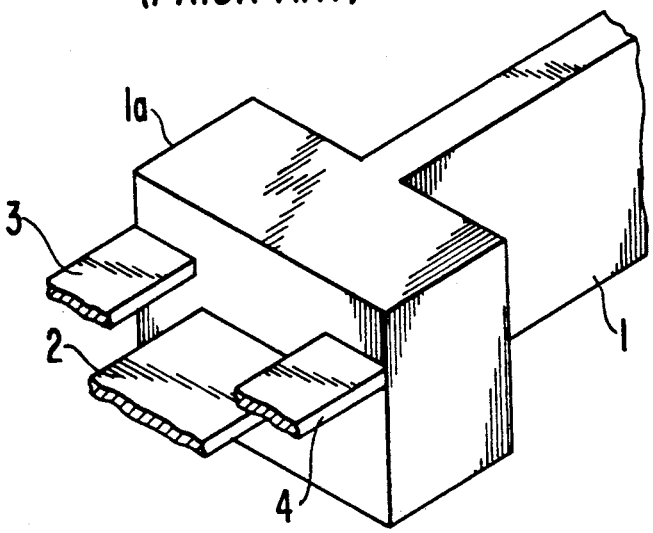
FIG. 2 (PRIOR ART)
FIG. 2 is a perspective view of a conventional connection part for the print element of FIG. 1.
Figure 3:
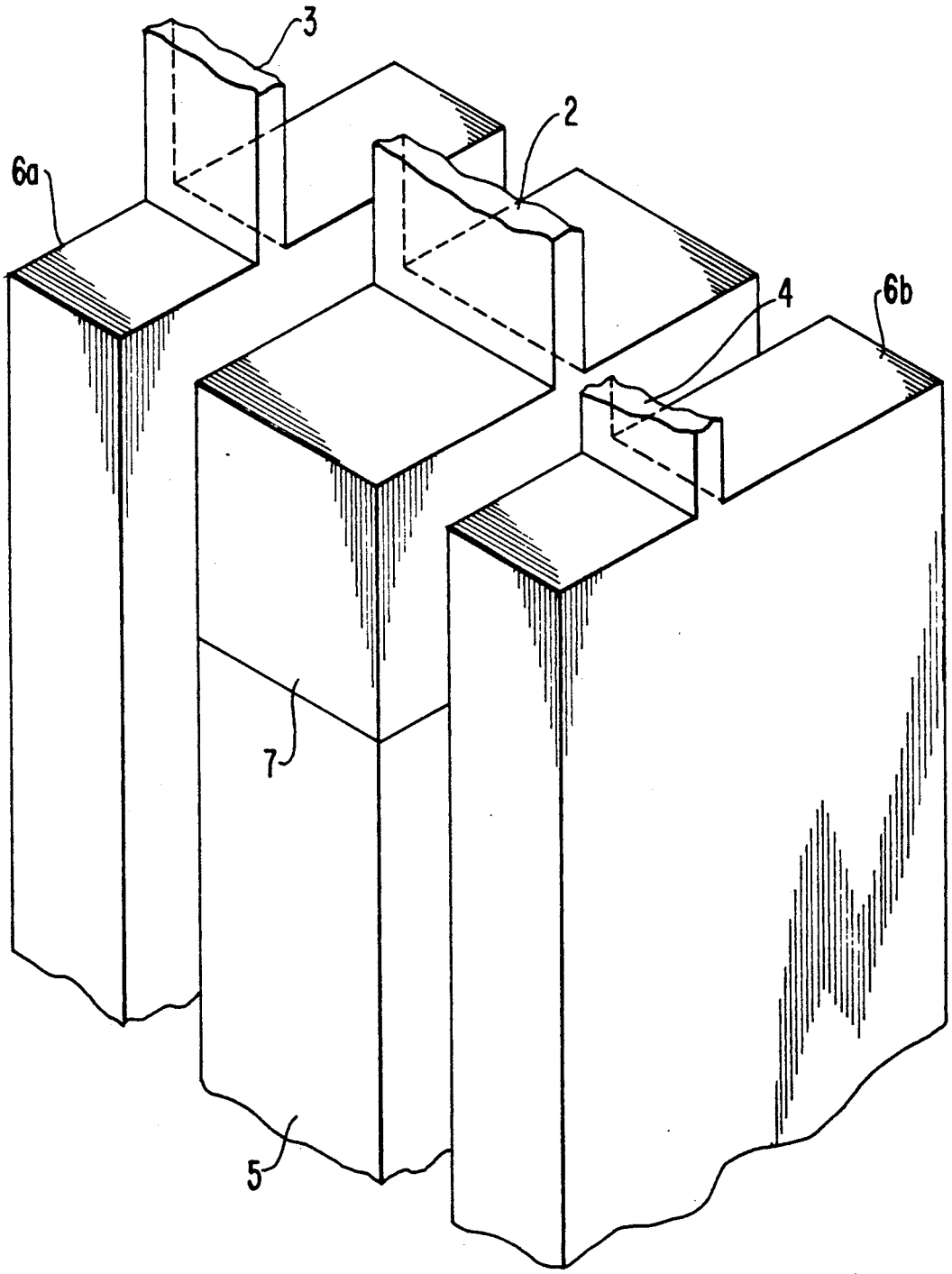
FIG. 3 (PRIOR ART)
FIG. 3 is a further perspective view of the conventional connection part for the print element of FIG. 1.
Figure 4:
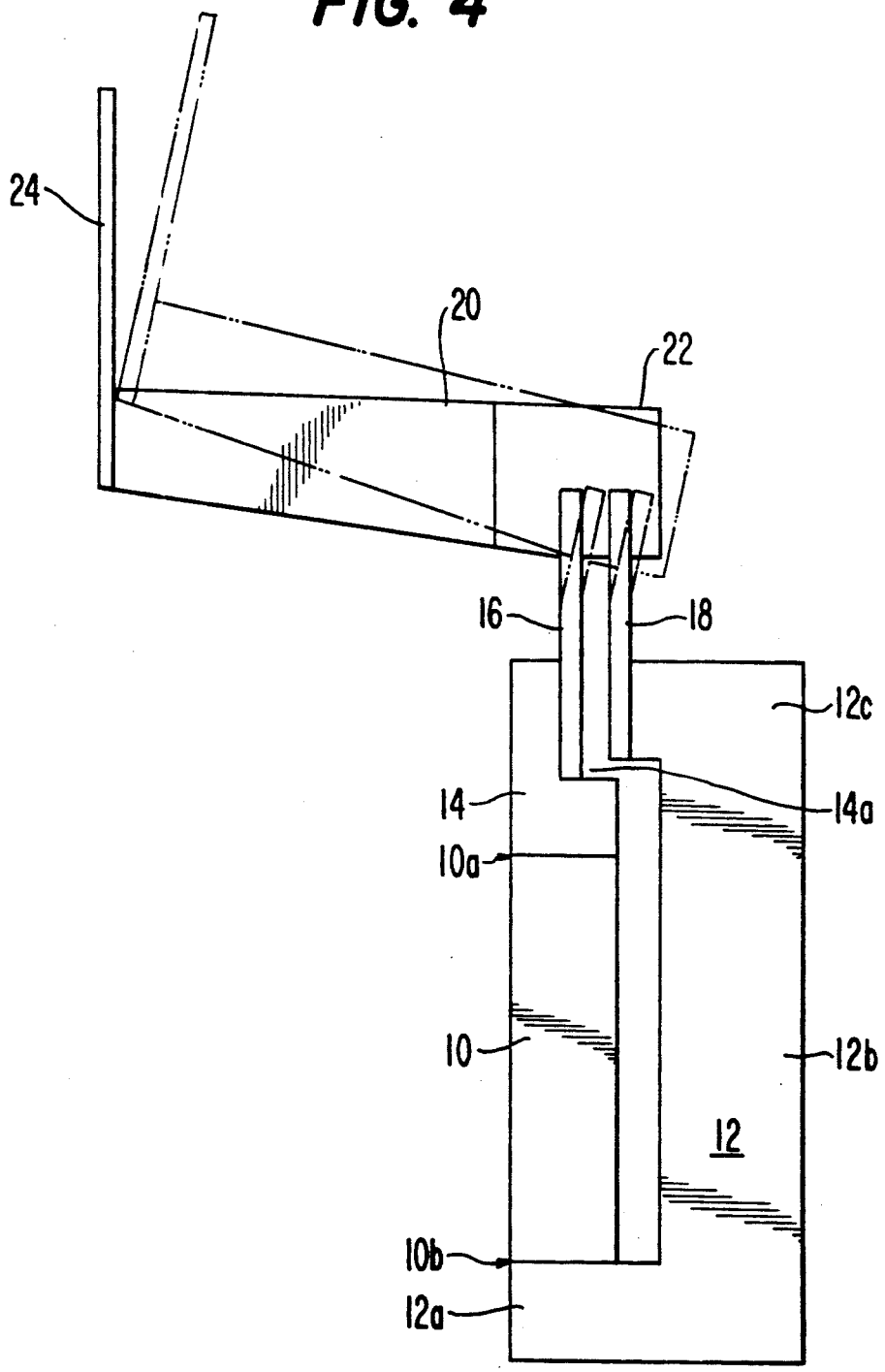
FIG. 4 is a side view illustrating an embodiment of a displacement magnifying mechanism for a print element in accordance with the present invention.
Figure 5:
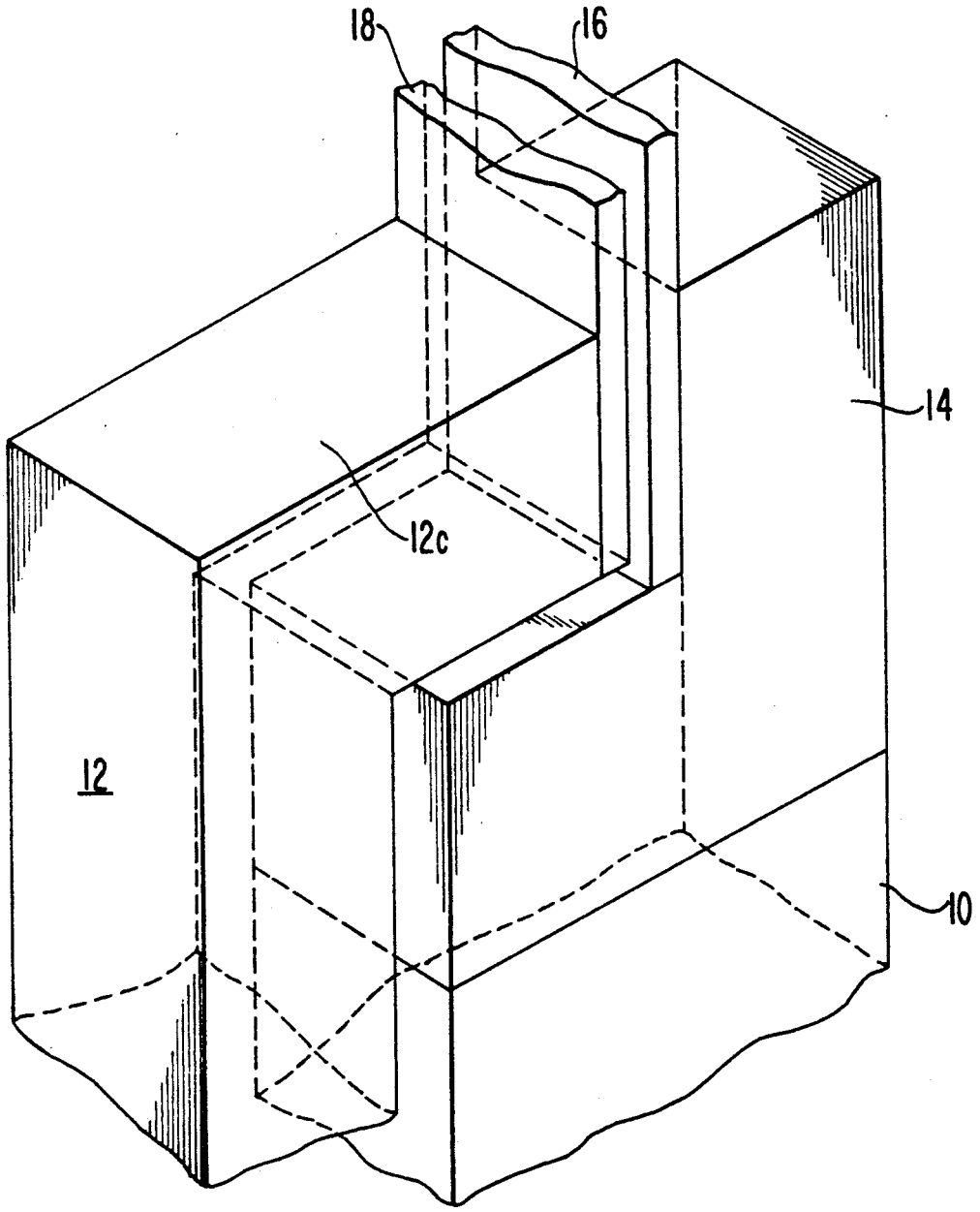
FIG. 5 is a perspective view illustrating an embodiment of part of a print element in accordance with the present invention shown in FIG. 4.
Figure 6:
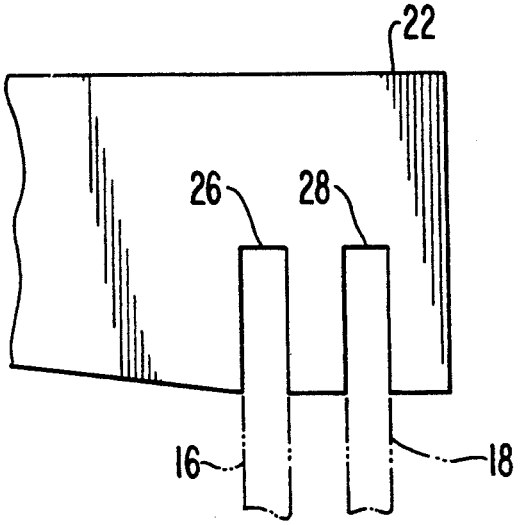
FIG. 6 is a side view illustrating an embodiment of part of a print element in accordance with the present invention shown in FIG. 4.

FIG. 4 is a side view illustrating an embodiment of a displacement magnifying mechanism for a print element in accordance with the present invention. FIG. 5 is a perspective view illustrating an embodiment of part of a print element in accordance with the present invention shown in FIG. 4. FIG. 6 is a side view illustrating an embodiment of part of a print element in accordance with the present invention shown in FIG. 4.

The displacement magnifying mechanism comprises an electro actuator 10, such as a piezo-electric element in a longitudinal mode, and a base member 12. The base member 12 includes a bottom section **12*a* and a side section 12*b*. The side section 12*b* of the base member 12 is arranged along the electro actuator 10, the electro actuator 10 has a free end 10*a* and a base end 10*b*. The electro actuator 10 has an element or actuator axis which passes through the base end 10*b* and the free end 10*a*. The base end 10*b* of the electro actuator 10 is connected to the bottom section 12*a* of the base member 12. The free end 10*a* of the electro actuator 10 has a junction member 14. The junction member 14 has a notch 14*a* formed therein, the junction member 14 being positioned such that the notch 14*a* faces the side section 12*b* of the base member 12. A top portion 12*c* of the side section 12*b* of the base member 12 extends substantially perpendicular to the notch 14*a* of the junction member 14, whereby the top portion 12*c* of the side section 12*b* of the base member 12 overlaps with the junction member 14** at a direction perpendicular to the actuator axis.

The electro actuator 10, such as the piezo-electric element, is depicted in FIG. 4 in a rest state, wherein no voltage is supplied across the piezo-electric element 10. When a voltage is supplied across the piezo-electric element 10, the piezo-electric element 10 is put in an actuated state to extend so that the free end **10*a* moves away from the base end 10*b* along the element axis. When the voltage is removed, the piezo-electric element 10 contracts along the element axis to return to the rest state. In summary, the piezo-electric element 10 has rest and actuated states in which the piezo-electric element 10 extends and contracts along the element axis to give a displacement to the free end 10*a* relative to the base end 10*b***.

There is a distance or gap between the top portion **12*c* of the side section 12*b* of the base member 12 and the junction member 14 at a direction parallel to the electro actuator 10 or along the element axis when the electro actuator 10** is extending in the actuated state.

The displacement magnifying mechanism also comprises an arm 20. The arm 20 has a base member 22 at one end of the arm 10 closest to top portion **12*c* and junction member 14. The base member 22 has two grooves 26, 28 as best shown in FIG. 6. In this embodiment, the displacement magnifying mechanism is applied to a print element. Consequently, the other end of the arm 20 has a print wire element 24** connected thereto.

The displacement magnifying mechanism also comprises a first resilient member 16 and second resilient member 18. The first and second resilient members 16, 18 are made of an elastic material, such as a rolled steel. The thickness of the first and second resilient members 16, 18 is 0.5 mm (0.19685 inches). One end of the first resilient member 16 is connected to the side surface of the notch **14*a* of the junction member 14, such as by laser welding. The other end of the first resilient member 16 is connected to the groove 26 of the base member 22 as shown in FIG. 6, such as by adhesive means. One end of the second resilient member 18 is connected to the side surface of the top position 12*c* of the side section 12*b* of the base member 12, such as by laser welding. The other end of the second resilient member 18 is connected to the groove 28 of the base member 22 as shown in FIG. 6, such as by adhesive means. The first and second resilient members 16, 18 are substantially parallel and substantially overlapping each other. As shown in FIG. 6, the base member 22 has two grooves 26, 28 for connecting the first and second resilient member 16, 18. The widths of the grooves 26, 28 are about 0.5 mm (0.19685 inches) and a distance between the groove 26 and groove 28** is about 1.0 mm (0.3937 inches).

Operation of the print element for this embodiment will now be described as follows. When a voltage is supplied across the piezo-electric element 10 (actuate state), the piezo-electric element 10 moves upward the junction member 14 a predetermined amount and a compression force is applied on the first resilient member 16. As a result, the first and second resilient members 16, 18 deform by elastic force and the arm 20 rotates clockwise up to the position indicated by a chain line shown in FIG. 4. As a result, the print wire 24 moves upwardly as indicated by a chain line. Then print wire 24 impacts the print medium (not shown) for printing. When the voltage is removed after a predetermined period, the piezo-electric element 10 contracts along the element axis to return to the rest state (initial position). The first and second resilient members 16, 18 also return to their initial positions. In this case, since extension and contraction of piezo-electric element 10 are carried out quickly, high speed printing can be realized by applying this displacement magnifying mechanism to a print head. Moreover, since the interval between the first and second resilient members 16, 18 can be narrowed without increasing the width of the mechanism, the mounting efficiency and displacement magnifying efficiency can also be improved at the same time.

Figure 7:
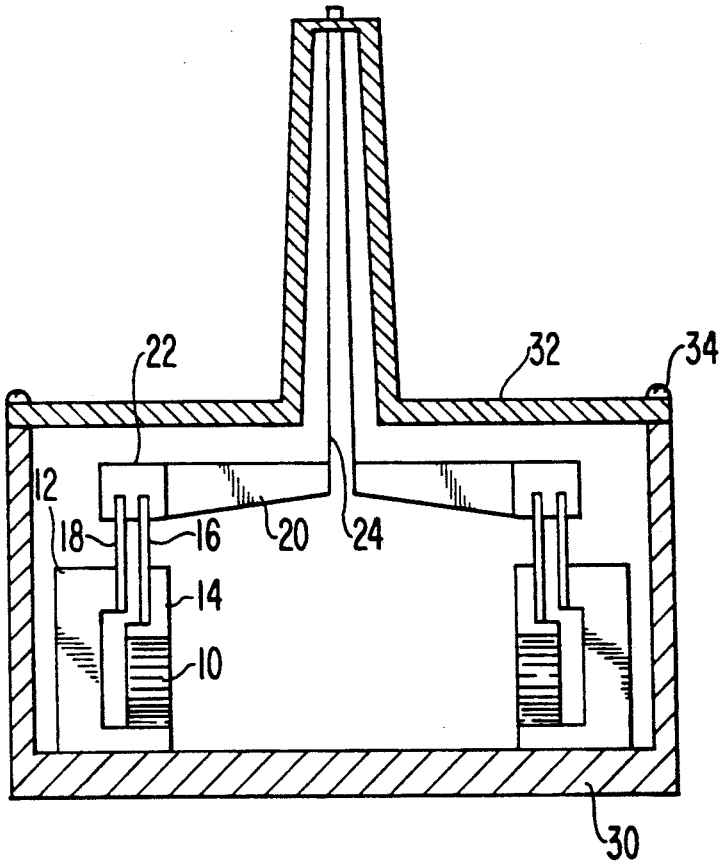
FIG. 7 is a side view illustrating an embodiment of a print head in accordance with the present invention.
Figure 8:
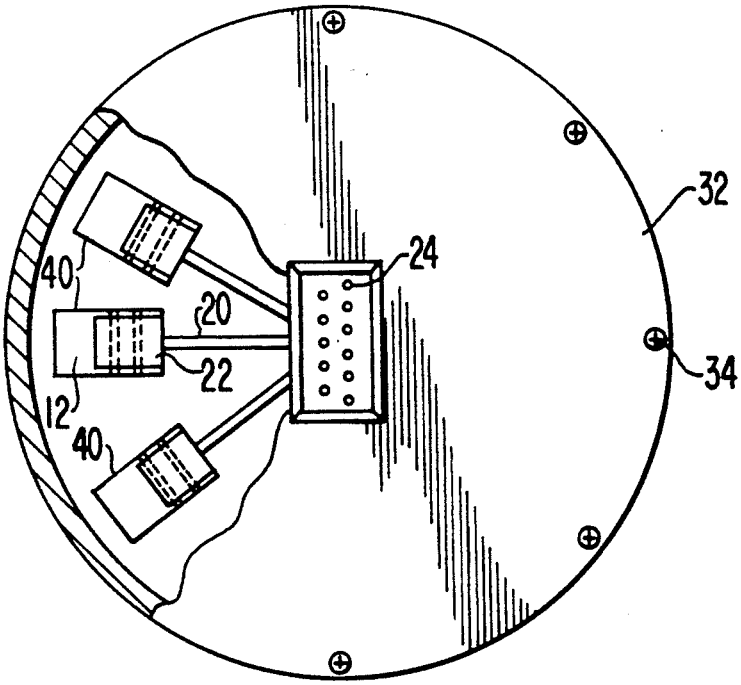
FIG. 8 is a top view illustrating the embodiment of the print head in accordance with the present invention shown in FIG. 7.

FIG. 7 is a side view illustrating an embodiment of a printer head in accordance with the present invention. FIG. 8 is a top view illustrating the embodiment of the printer head in accordance with the present invention shown in FIG. 7.

A printer head comprises a plurality of print elements 40, such as print elements of the type illustrated in FIG. 4. The printer head comprises a cylindrical type of printer head base member 30. The head base member 30 houses the print elements 40. The print elements 40 are arranged in the cylindrical part of base member 30 radially around the cylindrical central axis. The print wire 24 of each print element 40 extends upwardly through a cover 32 for the base member 30.

When a voltage is supplied across the piezo-electric element 10 of the selected print element 40, the print wire 24 is caused to move upwardly and the print wire 24 thus extends to the outside of the cover 32. Accordingly, a top of the print wire 24 can impact the print medium (not shown). When the voltage is removed after a predetermined period, the print wire 24 returns to the rest state.

Figure 10:
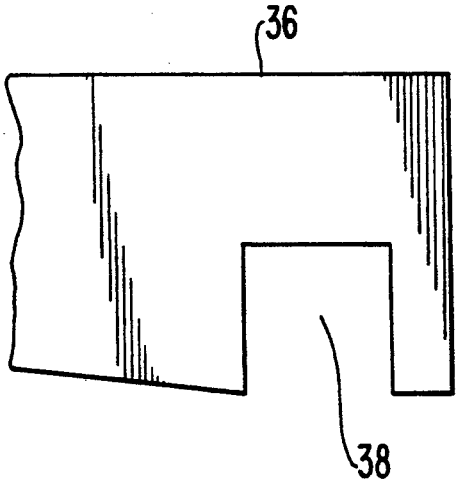
FIG. 10 is a side view illustrating an embodiment of a print element in accordance with the present invention shown in FIG. 9.
Figure 9:
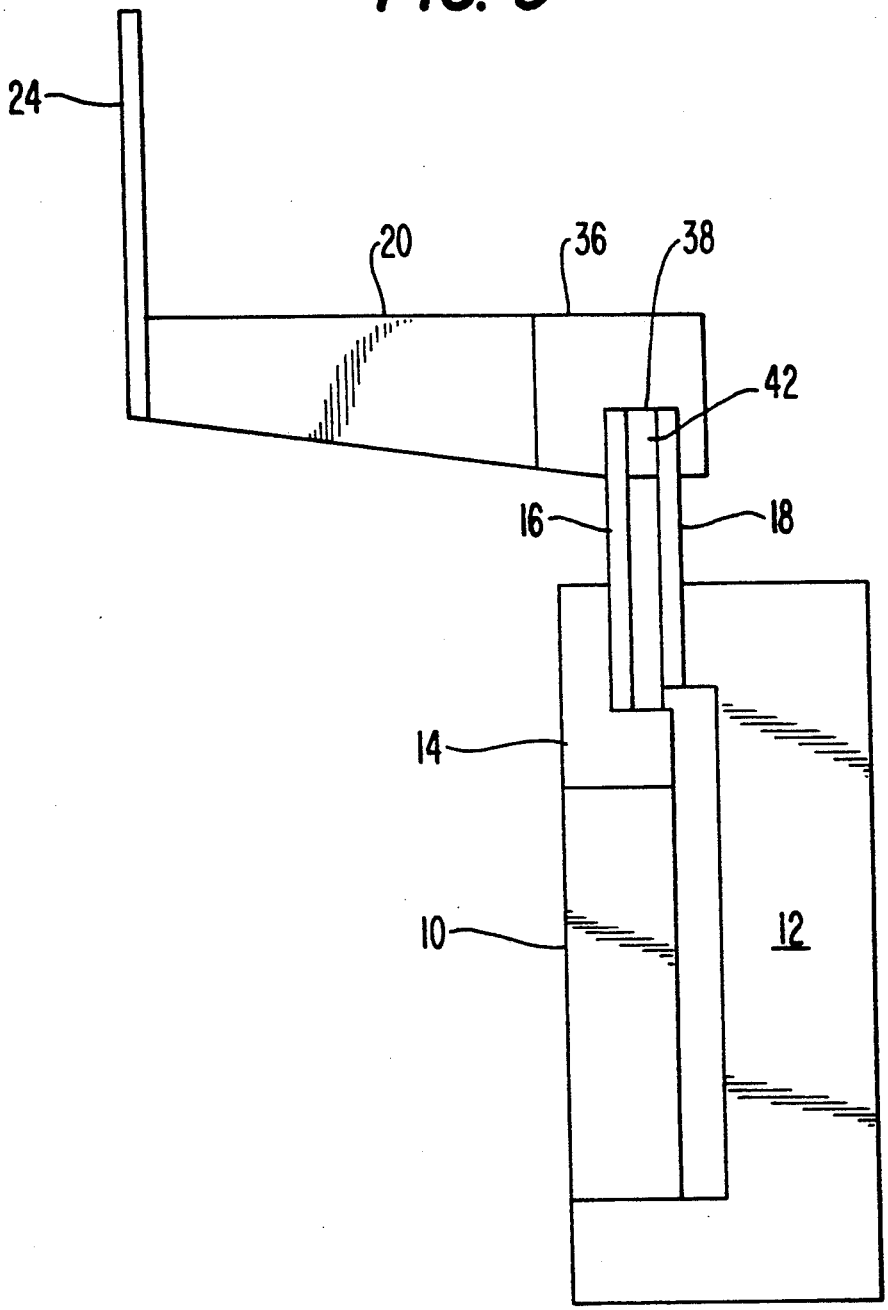
FIG. 9 is a side view illustrating another embodiment of a displacement magnifying mechanism for a print element in accordance with the present invention.

FIG. 9 is a side view illustrating another embodiment of a displacement magnifying mechanism for a print element in accordance with the present invention. FIG. 10 is a side view illustrating an embodiment of part of a print element in accordance with the present invention shown in FIG. 9.

In this embodiment, the arm 20 has a base member 36. The base member 36 has only one groove 38 as best shown in FIG. 10 for commonly connecting the arm 20 to the first and second resilient members 16, 18. As shown in FIG. 9, the first and second resilient members 16, 18 are connected in the groove 38 with a spacer 42 of a predetermined thickness (1.0 mm) disposed between the first and second resilient members 16, 18 and connected thereto with a bonding method. In this case, the assembly can be made easier by previously integrating the first and second resilient members 16, 18 with the spacer 42 by spot welding and then inserting the combined structure into the groove 38.

Since the first and second resilient members 16, 18 are fixed to the base member 36 of the arm 20 by interposing the spacer 42 of a predetermined thickness between them, the interval between the first and second resilient members 16, 18 thus being determined by that thickness of the spacer 42. Accordingly, accuracy of the interval between members 16 and 18 can be enhanced easily and the displacement magnifying efficiency can also be improved by reducing the thickness of the spacer 42. Moreover, since only one groove 38 is required to fix the first and second resilient members 16, 18 to the arm 20, the previously required high manufacturing accuracy is no longer necessary and a more economical displacement magnifying mechanism can be realized.

Figure 11:
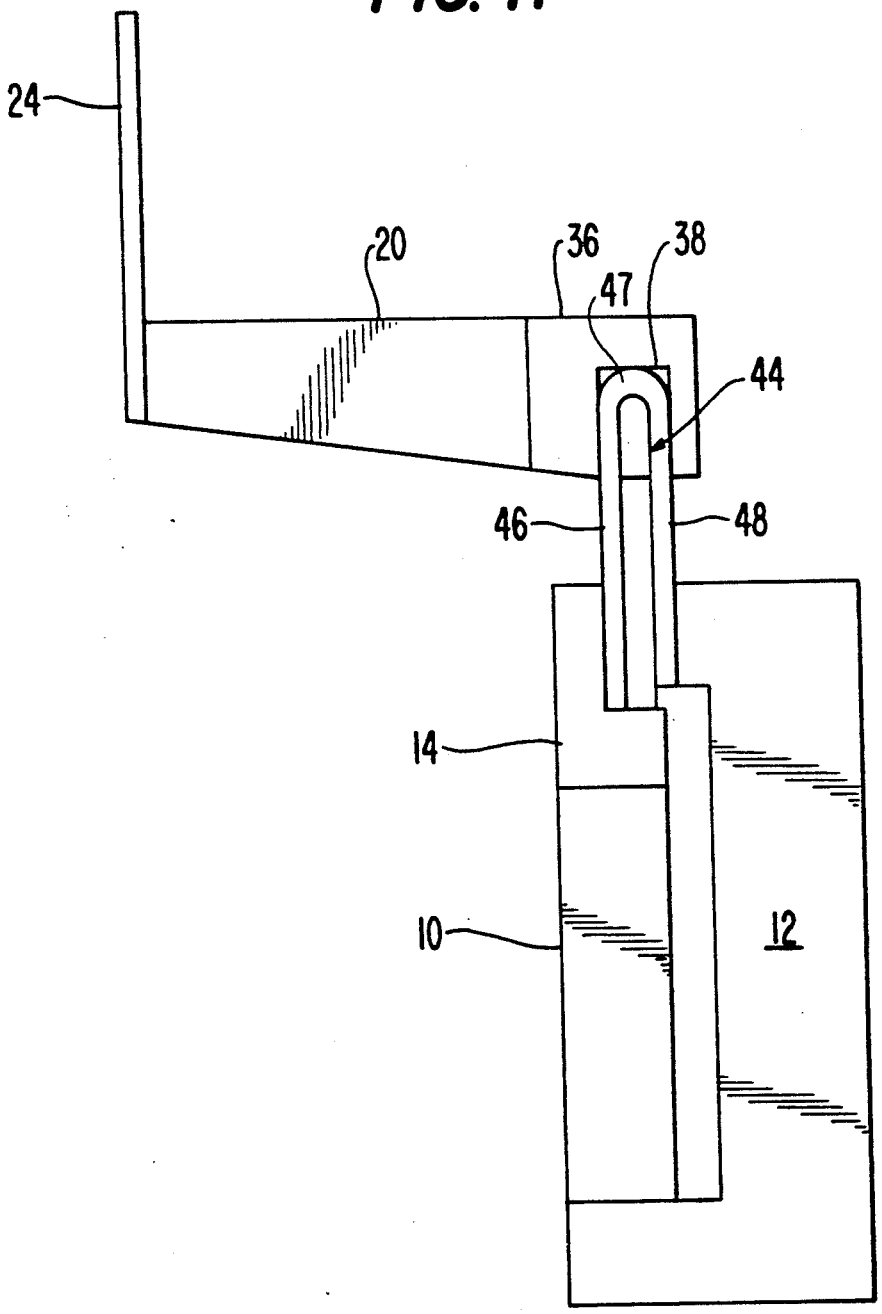
FIG. 11 is a side view illustrating another embodiment of a displacement magnifying mechanism for a print element in accordance with the present invention.

FIG. 11 is a side view illustrating another embodiment of a displacement magnifying mechanism for a print element in accordance with the present invention.

In this embodiment, the displacement magnifying mechanism has only a one-piece resilient member 44. However, the resilient member 44 includes a first resilient member part 46 and a second resilient member part 48 integrally formed. One end of the first resilient member part 46 is connected to the junction member 14 and one end of the second resilient member part 48 is connected to the base member 12 similar to that shown for the FIG. 4 embodiment. Also the base member 36 of the arm 20 has a single groove 38 such as shown for the FIG. 10 embodiment. A center part 47 of the resilient member 44 is bent in a "U" shape form and this center part 47 is inserted into the groove 38 of the base member 36. The resilient member 44 and the base member 36 are connected in the groove 38 of the base member 36 by a bonding method.

In the case of the embodiment of FIG. 11, the integral, one-piece resilient member 44 can be formed easily with high accuracy and the interval between the first and second resilient member parts 46, 48 can also be made small easily. Therefore, the displacement magnifying efficiency can be improved. Moreover, since only one groove 38 is necessary for the arm 20 and the previously required high manufacturing accuracy is not necessary, the displacement magnifying mechanism can be manufactured at low cost and assembled more easily.

Thus, it is intended that the present invention cover the modifications and variations in the displacement magnifying mechanism in accordance with the invention within the scope of the appended claims and their equivalents and without limitation to the different environments of a printer in which to use the mechanism.

What is claimed is:

1. A displacement magnifying mechanism comprising:

(a) a base member;

(b) an electro actuator having a free end, a base end connected to the base member, and an actuator axis defined as passing through the free end and the base end, the electro actuator having a rest state and an actuated state of extending and contracting along the actuator axis;

(c) an arm having a first end and a second end;

(d) a first resilient member having a first end connected to the free end of the electro actuator and a second end connected to the second end of the arm;

(e) a second resilient member having a first end connected to the base member and a second end connected to the second end of the arm, the second resilient member being substantially parallel and substantially overlapping with the first resilient member, and a distance between the first resilient member and second resilient member being less than a width of the electro actuator at a direction perpendicular to the actuator axis; and (f) a junction member at the free end of the actuator with an "L" shaped notch formed therein, wherein the notch has a side surface which is parallel to the actuator axis, the junction member is positioned such that the side surface of the notch faces a top position of a side section of the base member, and the top position of the side section of the base member extends to the notch of the junction member, and wherein the first resilient member is connected to the side surface of the notch of the junction member, and the second resilient member is connected to a surface of the top position of the side section of the base member such that the second resilient member faces in parallel the first resilient member connected in the notch of the junction member.

2. The displacement magnifying mechanism of claim 1, wherein the electro actuator comprises a piezo-electric element.

3. The displacement magnifying mechanism of claim 1, wherein the base member includes a bottom section for fixing the base end of the electro actuator, and the side section is arranged along the actuator axis of the electro actuator.

4. The displacement magnifying mechanism of claim 3, wherein the side section of the base member includes a connecting portion at the top position of the side section for connecting to the second resilient member.

5. The displacement magnifying mechanism of claim 4, wherein the top position of the side section of the base member extends substantially perpendicular toward the junction member whereby the top position of the side section of the base member overlaps with the junction member in a direction perpendicular to the actuator axis so that, when the electro actuator is extending in the actuated state, there is a gap between the top position of the side section of the base member and the junction member of the electro actuator in a direction parallel to the actuator axis.

6. The displacement magnifying mechanism of claim 1, wherein the second end of the arm includes a base member, and wherein the first and second resilient members are connected to the base member of the arm.

7. The displacement magnifying mechanism of claim 6, wherein the base member of the arm has groove means for connecting the first and second resilient members therein.

8. The displacement magnifying mechanism of claim 7, wherein the groove means comprises two grooves formed in the base member for independently connecting the first and second resilient members therein.

9. The displacement magnifying mechanism of claim 7, further comprising a spacer of a predetermined thickness, wherein the groove means comprises one groove formed in the base member, and wherein the first and second resilient members are fixed in the groove of the base member of the arm by interposing the spacer of predetermined thickness between the first and second resilient members.

10. The displacement magnifying mechanism of claim 1, wherein the first and second resilient members are formed as an integral one-piece body having a U-shaped center portion for fixing in the groove of the arm base member.

11. The displacement magnifying mechanism of claim 1, further comprising a printing member at the first end of the arm for applying the displacement magnifying mechanism to the print element of a print head, whereby, when the electro actuator is extending in the actuated state, the printing member impacts a print medium.

12. A print element for a print head comprising:

(a) a base member;

(b) an electro actuator having a free end, a base end connected to the base member, and an actuator axis defined as passing through the free end and the base end, the electro actuator having a rest state and an actuated state of extending and contracting along the actuator axis;

(c) an arm having a first end and a second end and having a base member positioned at the second end of the arm, the base member of the arm having a groove formed therein;

(d) a first resilient member having a first end connected to the free end of the electro actuator and a second end connected in the groove of the base member of the arm;

(e) a second resilient member having a first end connected to the base member and a second end connected to the groove of the base member of the arm, the second resilient member being substantially parallel with the first resilient member;

(f) a spacer interposed between the first and second resilient members for connection in the groove, the spacer having a predetermined thickness based on a required distance between the first and second resilient members, and the spacer being independent of the base member of the arm; and (g) a printing member fixed to the first end of the arm whereby, when the electro actuator is extending in the actuated state, the print member is impactable onto a print medium.

13. The print element of claim 12, wherein the electro actuator comprises a piezo-electric element.

14. The print element of claim 12, wherein the base member includes a bottom section for fixing the base of the electro actuator, and a side section arranged along the actuator axis of the electro actuator, and wherein the second resilient member is connected to the side section of the base member.

15. The print element of claim 14, wherein the electro actuator includes a junction member at the free end of the electro actuator for connection to the first resilient member, and wherein the side section of the base member includes a connecting portion at a top position of the side section for connecting to the second resilient member.

16. The print element of claim 15, wherein the top position of the side section of the base member extends substantially perpendicular toward the junction member whereby the top position of the side section of the base member overlaps with the junction member in a direction perpendicular to the actuator axis, so that, when the electro actuator is extending in the actuated states, there is a gap between the top position of the side section of the base member and the junction member of the electro actuator in a direction parallel to the actuator axis.

17. The print element of claim 16, wherein the junction member of the electro actuator has a notch formed therein, the junction member being positioned such that the notch faces the top position of the side section of the base member, and the top position of the side section of the base member being extended to the notch of the junction member.

18. The print element of claim 17, wherein the first resilient member is connected to a surface of the notch of the junction member, and the second resilient member is connected to a side surface of the top position of the side section of the base member such that the second resilient member faces in parallel the first resilient member connected to the surface of the notch of the junction member.

19. A displacement magnifying mechanism comprising:

(a) a base member;

(b) an electro actuator having a free end, a base end connected to the base member, and an actuator axis defined as passing through the free end and the base end, the electro actuator having a rest state and an actuated state of extending and contracting along the actuator axis;

(c) an arm having a first end and a second end, and having a base member positioned at the second end of the arm, the base member of the arm having a groove formed therein; and (d) an integral resilient member having a first resilient member part and a second resilient member part, the first resilient member part having a free end connected to the free end of the electro actuator, and the second resilient member part having a free end connected to the base member, the other ends of the first and second resilient member parts being integral in the form of a "U" shaped center part for connection in the groove of the arm; and (e) a junction member at the free end of the actuator with an "L" shaped notch formed therein, wherein the notch has a side surface which is parallel to the actuator axis, the junction member is positioned such that the side surface of the notch faces a top position of a side section of the base member, and the top position of the side section of the base member extends to the notch of the junction member, and wherein the first resilient member part is connected to the side surface of the notch of the junction member, and the second resilient member part is connected to a surface of the top position of the side section of the base member such that the second resilient member part faces in parallel the first resilient member part connected in the notch of the junction member.

20. The displacement magnifying mechanism of claim 19, wherein the electro actuator comprises a piezo-electric element.

21. The displacement magnifying mechanism of claim 19, wherein the base member includes a bottom section for fixing the base end of the electro actuator, and the side section is arranged along the actuator axis of the electro actuator, and wherein the second resilient member part is connected to the side section of the face member.

22. The displacement magnifying mechanism of claim 21, wherein the side section of the base member includes a connecting portion at the top position of the side section for connecting to the second resilient member part.

23. The displacement magnifying mechanism of claim 22, wherein the top position of the side section of the base member extends substantially perpendicular toward the junction member whereby the top position of the side section of the base member overlaps with the junction member in a direction perpendicular to the actuator axis so that, when the electro actuator is extending in the actuated state, there is a gap between the top position of the side section of the base member and the junction member of the electro actuator in a direction parallel to the actuator axis.

24. The displacement magnifying mechanism of claim 19, further comprising a printing member at the first end of arm for applying the displacement magnifying mechanism to a print element of a print head, whereby, when the electro actuator is extending in the actuated state, the print member impacts a print medium.

25. A printer head comprising:

(a) a plurality of print elements for printing to a print medium; and (b) a housing for positioning the plurality of print elements therein, wherein each of the print elements includes (i) a base member;

(ii) an electro actuator having a free end, a base end connected to the base member, and an actuator axis defined as passing through the free end and the base end, the electro actuator having a rest state and an actuated state of extending and contacting along the actuator axis;

(iii) an arm having a first end and a second end;

(iv) a first resilient member having a first end connected to the free end of the electro actuator and a second end connected to the second end of the arm;

(v) a second resilient member having a first end connected to the base member and a second end connected to the second end of the arm, the second resilient member being substantially parallel and substantially overlapping with the first resilient member, and a distance between the first resilient member and second resilient member being less than a width of the electro actuator at a direction perpendicular to the actuator axis;

(vi) a printing member fixed to the first end of the arm whereby, when the electro actuator is extending in the actuated state, the print member is impacted to a print medium; and (vii) a junction member at the free end of the actuator with an "L" shaped notch formed therein, wherein the notch has a side surface which is parallel to the actuator axis, the junction member is positioned such that the side surface of the notch faces a top position of a side section of the base member extends to the notch of the junction member, and wherein the first resilient member is connected to the side surface of the notch of the junction member, and the second resilient member is connected to a surface of the top position of the side section of the base member such that the second resilient member faces in parallel the first resilient member connected in the notch of the junction member.

26. The printer head of claim 25, wherein the electro actuator comprises a piezo-electric element.

27. The printer head of claim 25, wherein the base member includes a bottom section for fixing the base end of electro actuator, and the side section is arranged along with actuator axis of the electro actuator, and wherein the second resilient member is connected to the side section of the base member.

28. The printer head of claim 27, wherein the side section of the base member includes a connecting section at the top position of the side section for connecting to the second resilient member.

29. The printer head of claim 28, wherein the top position of the side section of the base member extends substantially perpendicular toward the junction member whereby the top position of the side section of the base member overlaps with the junction member in a direction perpendicular to the actuator axis so that, then the electro actuator is extending in the actuated state, there is a gap between the top position of the side section of the base member and the junction member of the electro actuator in a direction parallel to the actuator axis.

30. The printer head of claim 25, wherein the second end of the arm includes a base member, and wherein the first and second resilient members are connected to the base member of the arm.

31. The printer head of claim 30, wherein the base member of the arm has groove means for connecting the first and second resilient members therein.

32. The printer head of claim 31, wherein the groove means comprises two grooves formed in the base member for independently connecting the first and second resilient members therein.

33. The printer head of claim 31, further comprising a spacer of a predetermined thickness, wherein the groove means comprises one groove formed in the base member, and wherein the first and second resilient members are fixed in the groove of the base member of the arm by interposing the spacer of predetermined thickness between the first and second resilient members.

34. The printer head of claim 25, wherein the housing has top, bottom and side portions, wherein the plurality of print elements are arranged circumferentially around a center axis in the printer head housing, the plurality of printing members of the corresponding print elements being located centrally in the housing and substantially parallel to the side portions of the housing and substantially perpendicular to the top and bottom portions of the housing and moveable in a direction upwardly from the top portion of the housing to impact a print medium when the corresponding electro actuators are in actuated states, and wherein the plurality of electro actuators and first and second resilient members are located in the housing and extend in a direction substantially parallel to the plurality of printing members.

* * * * *

UNITED STATES PATENT AND TRADEMARK OFFICE

CERTIFICATE OF CORRECTION

PATENT NO. : 5,184,901

DATED : February 9, 1993

INVENTOR(S) : SHINZO TANAKA, et al.

It is certified that error appears in the above-identified patent and that said Letters Patent is hereby corrected as shown below:

TITLE PAGE - Abstract, line 2, "ene" s/b --end--;
line 5, "ene" s/b --end--.

Col. 1, line 53, before "resilient" insert --first--.

Col. 10, line 39, after "member" insert --, and the top position of a side section of the base member--.

Signed and Sealed this

Fourteenth Day of December, 1993

*Attest:*

*Attesting Officer*

BRUCE LEHMAN

*Commissioner of Patents and Trademarks*